US008080359B2

(12) United States Patent
Matsubara et al.

(10) Patent No.: US 8,080,359 B2
(45) Date of Patent: Dec. 20, 2011

(54) IMAGE FORMING METHOD

(75) Inventors: Masaharu Matsubara, Tokyo (JP); Asao Matsushima, Tokyo (JP); Noboru Ueda, Tokyo (JP); Go Yamaguchi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 615 days.

(21) Appl. No.: 11/946,982

(22) Filed: Nov. 29, 2007

(65) Prior Publication Data

US 2008/0166653 A1 Jul. 10, 2008

(30) Foreign Application Priority Data

Jan. 9, 2007 (JP) ..... 2007-001149

(51) Int. Cl.
*G03G 15/20* (2006.01)

(52) U.S. Cl. ..... 430/124.33; 430/124.32; 430/124.35; 430/124.3; 430/108.4; 399/329

(58) Field of Classification Search ..... 430/124.3, 430/124.32, 124.33, 124.35; 399/329
See application file for complete search history.

(56) References Cited

U.S. PATENT DOCUMENTS

| | | | | |
|---|---|---|---|---|
| 6,015,647 | A * | 1/2000 | Ugai et al. | 430/108.4 |
| 6,458,499 | B1 * | 10/2002 | Onuma et al. | 430/108.4 |
| 6,983,119 | B2 * | 1/2006 | Nakayama | 399/341 |
| 7,364,827 | B2 * | 4/2008 | Ueda et al. | 430/108.4 |
| 7,700,253 | B2 * | 4/2010 | Yamanouchi et al. | 430/108.4 |
| 2005/0196694 | A1 * | 9/2005 | Yuasa et al. | 430/108.4 |
| 2005/0226661 | A1 * | 10/2005 | Ohmura et al. | 399/333 |
| 2006/0286315 | A1 * | 12/2006 | Hashimoto et al. | 428/32.34 |
| 2007/0071522 | A1 * | 3/2007 | Kaji et al. | 399/329 |

* cited by examiner

*Primary Examiner* — Christopher Rodee
(74) *Attorney, Agent, or Firm* — Lucas & Mercanti, LLP

(57) ABSTRACT

An objective is to provide an image forming method by which sufficient fixing strength can be obtained at a low temperature of 120° C., excellent print images with no belt-like or streak image defect can be obtained, and no document offsetting is generated even though the superimposed print images are stored. Disclosed is an image forming method comprising the step of fixing a toner image formed with a toner comprising a releasing agent on a transfer material employing a contact-heating fixing device comprising a heating roller and a belt-shaped pressure body, wherein the heating roller is placed on the upper side of the transfer material, the releasing agent comprises the 1st releasing agent component and the 2nd releasing agent component, and the 1st releasing agent component has a content of 40-98% by weight, based on the total weight of the 1st and 2nd releasing agent components.

12 Claims, 2 Drawing Sheets

IMAGE FORMING METHOD

This application claims priority from Japanese Patent Appliction No. 2007-001149 filed on Jan. 9, 2007, which is incorporated hereinto by reference.

TECHNICAL FIELD

The present invention relates to an image forming method.

BACKGROUND

In response to demand for energy-saving in electrophotographic image forming apparatuses, to reduce energy consumed in the fixing device, whose consumption of electric power is the highest in the image forming apparatus, low-temperature fixing to perform image fixing at a relatively low temperature is promoted.

In order to accomplish low-temperature fixing, it is necessary to melt a binder resin contained in toner, and a mold releasing agent (hereinafter, also denoted as a releasing agent) at a relatively low fixing temperature, and it is contemplated to use a binder resin contained in toner, and a releasing agent (wax) which exhibit a low melt viscosity.

Further, in order to obtain a toner in response to such a low fixing temperature, it is necessary to use a releasing agent exhibiting a relatively low melting point and toners obtained by use of releasing agents exhibiting a low melting point (hereinafter, also referred to as a low-melting point releasing agent) were disclosed (refer to Patent Documents 1 and 2).

From a viewpoint of environmental conservation, further reduction of energy consumed by an image forming apparatus is desired, and improvement in fixing efficiency with a fixing device, together with development of toner used for the foregoing low temperature fixing has also been investigated. As such a fixing device, disclosed is a fixing device equipped with a heating roller and a belt-shaped pressure body in combination in place of one equipped with a heating roller and a pressure roller in combination (refer to Patent Document 3, for example).

This fixing device is one by which fixing efficiency is improved by employing a belt-shaped member for a pressure body to expand the nip portion width in the fixing area.

(Patent Document 1) Japanese Patent O.P.I. Publication No. 2000-321815

(Patent Document 2) Japanese Patent O.P.I. Publication No. 2000-275908

(Patent Document 3) Japanese Patent O.P.I. Publication No. 10-228198

SUMMARY

In the case of conducting a fixing treatment employing a contact-heating fixing device equipped with a heating roller and a belt-shaped pressure body in combination with the proposed toner employed for low temperature fixing, however, there were problems such that belt-like or streak image defects were generated in fixed images, and document offsetting was generated when the resulting superimposed prints were left standing.

Therefore, when the fixing treatment was conducted at lower temperature in order to solve the above-described problem, there was produced a problem such that fixability (fixing strength) was degraded though the belt-like or streak image defects were inhibited.

Demanded is development of an image forming method, employing a contact-heating fixing device equipped with a heating roller and a belt-shaped pressure body, by which no belt-like or streak image defect is generated in a low temperature fixing treatment, whereby print images to satisfy fixing strength are obtained, and no document offsetting is generated even though the superimposed print images are stored.

The present invention has been made on the basis of the above-described situation. It is an object of the present invention to provide an image forming method by which sufficient fixing strength can be obtained even at a low temperature of for example 120° C., excellent print images with no belt-like or streak image defect can be obtained, and no document offsetting is generated even though the superimposed print images are stored. Also disclosed is an image forming method comprising the step of fixing a toner image formed with a toner possessing a releasing agent on a transfer material employing a contact-heating fixing device possessing a heating roller and a belt-shaped pressure body, wherein the heating roller is placed on an unfixed toner image side of the transfer material; the releasing agent comprises a $1^{st}$ releasing agent component containing a monoester compound represented by the following Formula (1) and a $2^{nd}$ releasing agent component containing a hydrocarbon compound having a branched chain structure; and the $1^{st}$ releasing agent component has a content of 40-98% by weight, based on the total weight of the $1^{st}$ releasing agent component and the $2^{nd}$ releasing agent component: Formula (1) $R^1$—COO—$R^2$ wherein $R^1$ and $R^2$ each represent a hydrocarbon group with a main chain having 13-30 carbon atoms, that may have a substituent, or may not have a substituent, and $R^1$ and $R^2$ each may be identical or different.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

Figure 1:
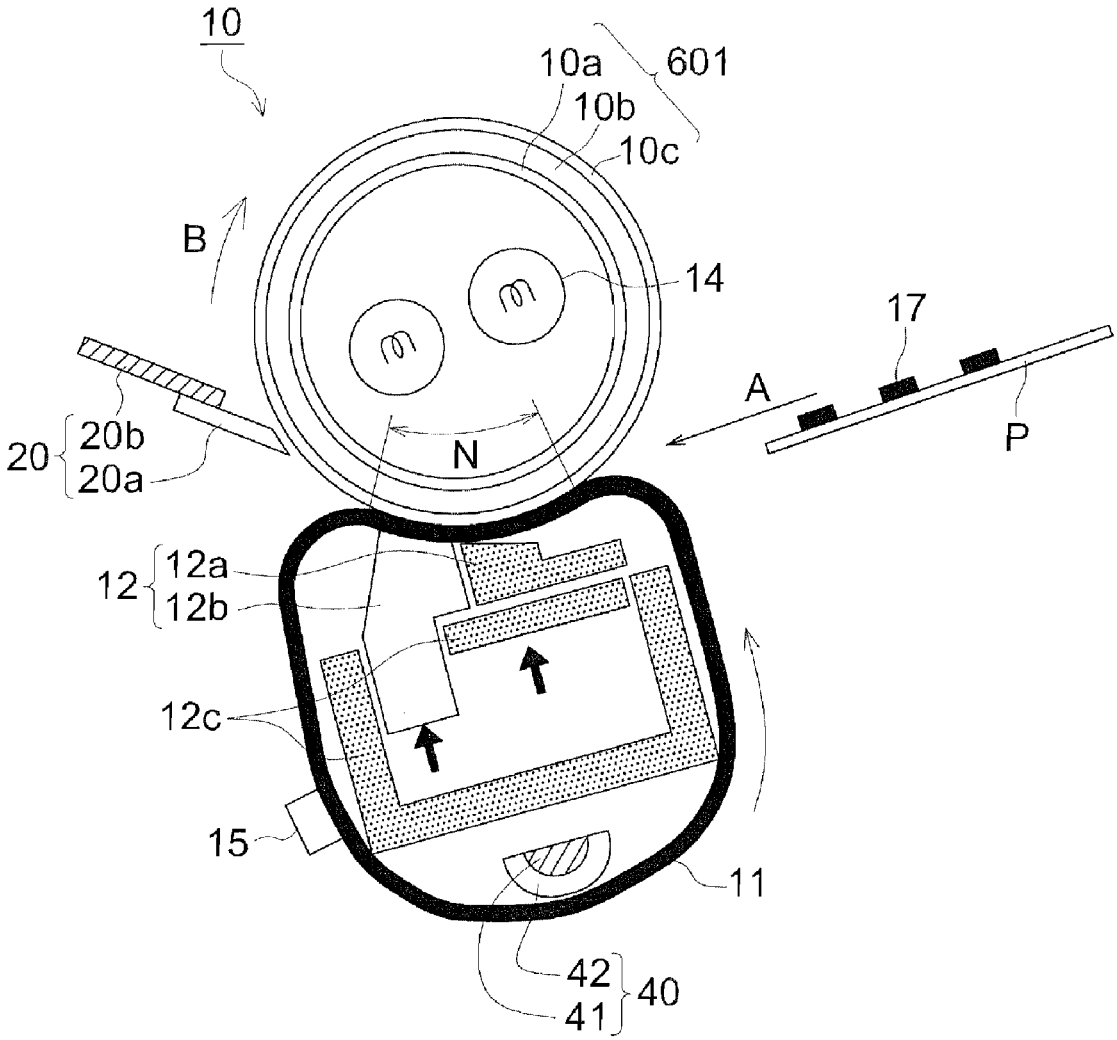
FIG. 1 is an illustrative diagram showing an example of a contact heating fixing device fitted with a heating roller and a seamless belt employed in the present invention.

DESCRIPTION OF THE PREFERRED EMBODIMENTS (Structure 1) An image forming method comprising the step of fixing a toner image formed with a toner comprising a releasing agent on a transfer material employing a contact-heating fixing device comprising a heating roller and a belt-shaped pressure body, wherein the heating roller is placed on an unfixed toner image side of the transfer material; the releasing agent comprises a $1^{st}$ releasing agent component containing a monoester compound represented by the following Formula (1) and a $2^{nd}$ releasing agent component containing a hydrocarbon compound having a branched chain structure; and the $1^{st}$ releasing agent component has a content of 40-98% by weight, based on the total weight of the $1^{st}$ releasing agent component and the $2^{nd}$ releasing agent component.

$$R^1\text{—COO—}R^2 \qquad \text{Formula (1)}$$

wherein $R^1$ and $R^2$ each represent a hydrocarbon group with a main chain having 13-30 carbon atoms, that may have a substituent, or may not have a substituent, and $R^1$ and $R^2$ each may be identical or different.

(Structure 2) The image forming method of Structure 1, wherein the $1^{st}$ releasing agent component has a content of 70-95% by weight, based on the total weight of the $1^{st}$ releasing agent component and the $2^{nd}$ releasing agent component.

(Structure 3) The image forming method of Structure 1, wherein tertiary carbon atoms and quaternary carbon atoms in the total carbon atoms constituting the hydrocarbon compound having a branched chain structure have a content of 0.1-20% by weight.

(Structure 4) The image forming method of Structure 1, wherein tertiary carbon atoms and quaternary carbon atoms in the total carbon atoms constituting the hydrocarbon compound having a branched chain structure have a content of 0.3-1.0% by weight.

(Structure 5) The image forming method of Structure 1, wherein the hydrocarbon compound having a branched chain structure is microcrystalline wax.

(Structure 6) The image forming method of Structure 5, wherein the microcrystalline wax has 30-60 carbon atoms, a weight-average molecular weight of 500-800 and a melting point of 60-90° C.

(Structure 7) The image forming method of Structure 1, wherein a nip portion formed with the heating roller and the belt-shaped pressure body has a width of 5-40 mm.

(Structure 8) The image forming method of Structure 1, wherein a nip portion formed with the heating roller and the belt-shaped pressure body has a width of 10-30 mm.

(Structure 9) The image forming method of Structure 1, wherein the belt-shaped pressure body is a seamless belt.

(Structure 10) The image forming method of Structure 9, wherein the seamless belt is one having a layered structure formed from silicone rubber elastic layers and a PFA (perfluoroalkoxy) outer surface layer provided on a polyimide substrate.

(Structure 11) The image forming method of Structure 9, wherein the seamless belt is one having a layered structure obtained by coating a releasing layer, in which a conductive material is added into a fluorine resin on a polyester substrate, a polyperfluoroalkyl vinyl ether substrate, a polyimide substrate or a polyetherimide substrate.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

After considerable effort during analyses of the cause of generating belt-like or streak image defect, the inventors have found out that a stain of the charging electrode together with a stain of the exposure system is generated by attaching releasing agent molecules onto the inside of the device. It seemed unlikely that vaporization was generated, since the boiling point of releasing agent itself was high thought the melting point was low. However, vapor pressure at a temperature below the boiling point is lowered as the melting point of a releasing agent is lowered in order to realize low temperature fixing, whereby it is assumed that vaporized releasing agent molecules are increased at the temperature of a fixing device, or releasing agent molecules having a vaporizable structure are increased.

That is, in the case of forming images via thermal fixation employing the toner with a low melting point releasing agent, a vapor component is generated by heat in the device since the low melting point releasing agent contains the comparatively vaporizable component. The vapor component caused charging unevenness via adhesion to a charging electrode and so forth in a charging device, and streak defects were generated upon exposure of light via adhesion to a polygon mirror in the exposure system, so that it was confirmed that image defects were generated.

This phenomenon tends to be generated in the case of a contact-heating fixing device in which a heating roller is placed on the unfixed toner image side of a transfer material.

On the other hand, desired is a fixing device in which a nip portion width via a heating roller and a belt-shaped pressure body can be arranged wider for low temperature fixing. Specifically demanded is one in which a heating belt was placed on the upper side of a transfer material so as to be placed on the unfixed toner image side of the transfer material, and a pressure roller was placed on the lower side of the transfer material in order to inhibit heat applied to the unfixed toner image as well as degradation of the belt-shaped pressure body.

In order to accomplish the present invention, the present invention is focused on a structure of the low melting point releasing agent, and found has been an image forming method in which sufficient fixing strength is obtained in combination with a contact-heating fixing device exhibiting excellent fixing efficiently by inhibiting generation of a vapor component, excellent print images with no belt shaped and streak image defect are obtained, and no document offsetting is generated during storing superimposed print images.

In addition, document offsetting of the present invention means a phenomenon in which a toner image is transferred to the reverse side of a toner material when the superimposed printed transfer materials are left standing, and the transfer materials are stuck.

The reason why a problem of fixing strength has been solved is not clear, but it is assumed that fixing strength was able to be obtained because of excellent fixability, even though a contact-heating fixing device having a wide nip portion width, which was equipped with a heating roller and a belt-shaped pressure body was utilized in combination with the toner used with the above-described releasing agent.

As to the reason why generation of belt-shaped and streak image defects can be inhibited, it is assumed that an amount vaporized from the inside of toner is reduced by fixing the toner with less vapor component at low temperature, whereby stains of the charging electrode and the exposure system caused by the vapor component are reduced.

As to the reason why generation of document offsetting can be inhibited, it is assumed that the foregoing is accomplished by melt-fixing the toner with less vapor component onto a transfer material to reduce the vapor component amount to breed out during storing.

Next, the present invention will be described in detail.

(Toner)

A toner of the present invention comprising a binder resin, a colorant, and releasing agents, wherein the releasing agents are composed of at least the $1^{st}$ releasing agent component containing a monoester compound represented by the following Formula (1) and the $2^{nd}$ releasing agent component containing a hydrocarbon compound having a branched chain structure. In addition, the $1^{st}$ releasing agent component has a content of 40-98% by weight, based on the total weight of the 1st releasing agent component and the $2^{nd}$ releasing agent component, and preferably has a content of 70-95% by weight.

$$R^1—COO—R^2 \qquad \text{Formula (1)}$$

wherein $R^1$ and $R^2$ each represent a hydrocarbon group with a main chain having 13-30 carbon atoms, that may have a substituent, or may not have a substituent, and $R^1$ and $R^2$ each may be identical or different.

In the case of the 1st releasing agent component having a content of at least 40% by weight, based on the total weight of the 1st releasing agent component and the 2nd releasing agent component, sufficient adhesion can be maintained since adhesion to the transfer material is increased in the entire region of a toner image via presence of polar groups with the monoester compound.

On the other hand, in the case of a content of the 1st releasing agent component exceeding 98% by weight, obtained is no sufficient separation action between the heating roller and the transfer material via action of the after-mentioned 2nd releasing agent component as a nonpolar releasing agent,

[The 1st Releasing Agent Component]

In Formula (1) representing a monoester compound as the 1st releasing agent component constituting a releasing agent, $R^1$ and $R^2$ each represent a hydrocarbon group with a main chain having 13-30 carbon atoms, and preferably 17-22 carbon atoms, that may have a substituent, or may not have a substituent, and $R^1$ and $R^2$ each may be identical or different.

Such the monoester compound exhibits the low pelting point, and has a structure in which a vapor component is difficult to be generated. As to this reason, it is assumed that the monoester compound is evenly dispersed with a hydrocarbon compound containing a branched chain structure in view of compatibility with the hydrocarbon compound containing the branched chain structure as the 2nd releasing agent component.

In the present invention, excellent adhesion to the transfer material, which can not be obtained by only the hydrocarbon compound containing a branched chain structure, is realized by containing the 1st releasing agent component constituting a releasing agent formed from a monoester compound, and the fixing treatment can be sufficiently conducted.

Specific examples of the monoester compound represented by above-described Formula (1) include the following compounds represented by Formulae (a)-(h).

$CH_2—(CH_2)_{12}—COO—(CH_2)_{13}—CH_3$ Formula (a)

$CH_3—(CH_2)_{14}—COO—(CH_2)_{15}—CH_3$ Formula (b)

$CH_3—(CH_2)_{16}—COO—(CH_2)_{17}—CH_3$ Formula (c)

$CH_3—(CH_2)_{16}—COO—(CH_2)_{21}—CH_3$ Formula (d)

$CH_3—(CH_2)_{20}—COO—(CH_2)_{17}—CH_3$ Formula (e)

$CH_3—(CH_2)_{20}—COO—(CH_2)_{21}—CH_3$ Formula (f)

$CH_3—(CH_2)_{25}—COO—(CH_2)_{25}—CH_3$ Formula (g)

$CH_3—(CH_2)_{28}—COO—(CH_2)_{29}—CH_3$ Formula (h)

As to these monoester compounds, group $R^1$ and group $R^2$ preferably have a straight chain structure in view of low melting point, but those having a branched chain structure may be used.

Specific examples of the monoester compound having a branched chain structure include the following compounds represented by Formulae (i) and (j).

Formula (i)

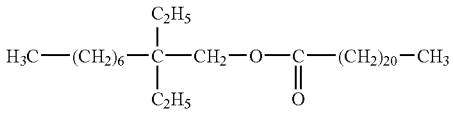

Formula (j)

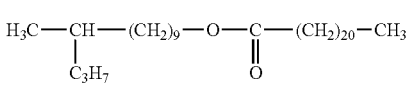

[The 2nd Releasing Agent Component]

The 2nd releasing agent component constituting a releasing agent is a hydrocarbon compound having a branched chain structure. As to a branching ratio in a hydrocarbon compound having a branched chain structure, in other words, tertiary carbon atoms and quaternary carbon atoms in the total carbon atoms constituting a hydrocarbon compound having a branched chain structure preferably have a content of 0.1-20% by weight, and more preferably have a content of 0.3-1.0% by weight. These values are obtained by the following method. Incidentally, branched hydrocarbon based wax may be an admixture of a hydrocarbon compound having a branched chain structure and a hydrocarbon compound having no branched chain structure, that is, a straight chain hydrocarbon compound.

The 2nd releasing agent component has a content of 2-60% by weight, based on the total weight of the 1st releasing agent component and the 2nd releasing agent component, and preferably has a content of 5-30% by weight.

When a ratio of the sum of tertiary carbon atoms and quartanary carbon atoms to the total carbon atoms constituting a hydrocarbon compound having a branched chain structure is in the range of 0.1-20%, the hydrocarbon compound makes the vapor component difficult to generate despite the low melting point.

The non-polar second releasing component produces an excellent effect on separation action between the heating roller and the transfer material.

The branching ratio of a hydrocarbon compound having a branched chain structure can be specifically determined according to the following Equation (1) based on a spectrum obtained via 13C-NMR spectrometry under conditions as described below.

$$\text{Branching ratio (\%)}=(C3+C4)/(C1+C2+C3+C4)\times 100 \quad \text{Equation (1)}$$

wherein C3 represents a peak area related to tertiary carbon atoms, C4 represents a peak area related to quaternary carbon atoms, C1 represents a peak area related to primary carbon atoms and C2 represents a peak area related to secondary carbon atoms.

(Condition of 13C-NMR spectrometry)

Measuring apparatus: FT NMR spectrometer Lambda 400 (manufactured by Nippon Denshi Co., Ltd.)
Measuring frequency: 100.5 MHz
Pulse condition: 4.0 μs
Data point: 32768
Delay time: 1.8 sec
Frequency range: 27100 Hz
The number of integration: 20000
Measured temperature: 80° C.
Solvent: benzene-$d_6$/o-dichlorobenzene-$d_4$=¼ (v/v)
Sample concentration: 3% by weight
Sample tube: ϕ5 mm
Measurement mode: 1H complete decoupling method Specific examples of a hydrocarbon compound having a branched chain structure include microcrystalline waxes such as HNP-0190, Hi-Mic-1045, Hi-mic-1070, Hi-Mic-1080, Hi-Mic-1090, Hi-Mic-2045, Hi-Mic-2065 and Hi-Mic-2095 (produced by Nippon Seiro Co., Ltd.) and waxes mainly containing an isoparaffin wax, such as waxes EMW-0001 and EMW-0003.

Of these, HNP-0190 having a branched chain structure ratio of 0.1-20% is preferable.

A microcrystalline wax which is one of petroleum waxes and differs from a paraffin wax which is mainly comprised of straight chain hydrocarbon (normal paraffin), is generally a wax containing branched chain hydrocarbon (isoparaffin). Generally, a microcrystalline wax, which is mainly comprised of low-crystalline isoparaffin and cycloparaffin, is composed of smaller crystals and exhibits a larger molecular weight, compared with a paraffin wax. Such the microcrystalline wax has 30-60 carbon atoms, a weight-average molecular weight of 500-800 and a melting point of 60-90° C.

A microcrystalline wax, as a hydrocarbon compound having a branched chain structure is preferably one having a weight average molecular weight of 600-800 and a melting point of 60-85° C. Further, one having a low molecular weight with a number average molecular weight of 300-1,000 is preferable, and one with a number average molecular weight of 400-800 is more preferable. The ratio of weight average molecular weight to number average molecular weight (Mw/Mn) is preferably 1.01-1.20.

(Method of Producing Hydrocarbon Compound Having Branched Chain Structure)

Methods of producing a hydrocarbon compound having a branched chain structure include, for example, a press-sweating method in which solidified hydrocarbon is separated, while maintaining raw oil at a specific temperature and a solvent extraction method in which a solvent is added to petroleum vacuum distillation residual oil or raw oil of heavy distillates to cause crystallization and is further subjected to filtration. Among these methods, the solvent extraction method is preferred. A hydrocarbon compound having a branched chain structure which can be obtained by the manufacturing methods described above is colored and may be purified by using a sulfuric acid clay and the like.

As to the second releasing agent component constituting a releasing agent used for toner of the present invention, the above-described hydrocarbon compound having a branched chain structure may be used in combination with at least two kinds.

A releasing agent in the toner of the present invention preferably has a content of 1-30% by weight, and more preferably has a content of 5-20% by weight.

The whole releasing agents constituting the toner of the present invention have a melting point of 60-100° C., and preferably have a melting point of 65-85° C.

The melting point represents a temperature at the top of an endothermic peak of the releasing agent, which can be determined by using, for example, DSC-7 differential scanning calorimeter (produced by Perkin Elmer, Inc.) or TAC7/DX thermal analyzer controller (produced by Perkin Elmer, Inc.).

To be more concrete, 4.00 mg of a releasing agent is weighed at a precision to two places of decimals and enclosed in an aluminum pan (KITNO. 0219-0041), and then set onto a DSC-7 sample holder. Temperature control of Heat-Cool-Heat is carried out, while measuring conditions of a measurement temperature of 0-200° C., a temperature-increasing speed of 10° C./min and temperature-decreasing speed of 10° C./min, and analysis was conducted based on the data of the 2nd Heat. Measurement for reference was performed using an empty aluminum pan.

(Method of Manufacturing Toner)

Methods of manufacturing the toner of the present invention are not specifically limited, and examples thereof include a pulverization method, a suspension polymerization method, a mini-emulsion polymerization coagulation method, an emulsion polymerization coagulation method, a solution suspension method and a polyester molecule elongation method. Of these methods, the mini-emulsion polymerization coagulation method is specifically preferred, in which, in an aqueous medium containing a surfactant at a concentration lower than the critical micelle concentration, a polymerizable monomer solution containing a releasing agent dissolved in a polymerizable monomer is dispersed by employing mechanical energy to form oil droplets (10-1000 nm in size) to prepare a dispersion; to the prepared dispersion, a water-soluble polymerization initiator is added to perform radical polymerization to obtain binder resin particles; the obtained binder resin particles were coalesced (coagulated and fused) to obtain a toner.

In the foregoing method, polymerization is performed in the form of oil droplets so that in the individual toner particles, releasing agent molecules are definitely enclosed in the binder resin. It is therefore supposed that generation of volatile components of the releasing agent is inhibited until subjected to fixing in a fixing device or heated.

In the foregoing mini-emulsion polymerization coagulation method, an oil-soluble polymerization initiator may be added into the monomer solution, in place of or concurrently with addition of the water-soluble polymerization initiator.

As the method of manufacturing the toner of the present invention, binder resin particles formed in the mini-emulsion polymerization coagulation method may be arranged to be used for a structure of at least two layers. In this case, a polymerization initiator and a polymerizable monomer are added into a dispersion of first resin particles prepared by mini-polymerization according to the conventional manner (the first step polymerization), and this system can be utilized for a polymerization treatment (the second step polymerization).

To be more specific, the mini-emulsion polymerization coagulation method as a method of manufacturing the toner comprises:

(1) dissolution/dispersion step in which toner particle constituent materials such as a releasing agent, a colorant and optionally, a charge controlling agent are dissolved or dispersed in a polymerizable monomer to form a binder resin to obtain a polymerizable monomer solution, (2) polymerization step in which the polytnerizable monomer solution is dispersed in the form of oil-droplets dispersed in an aqueous medium and polymerized via a mini-emulsion method to prepare a dispersion of binder resin particles, (3) coagulation/fusion step in which the binder resin particles are allowed to be salted out, coagulated and fused to form coalesced particles, (4) ripening step in which the coalesced particles are thermally ripened to control the particle form to obtain a dispersion of toner particles, (5) cooling step in which the toner particle dispersion is cooled, (6) filtration/washing step in which toner particles are separated through solid/liquid separation from the cooled toner particle dispersion, and surfactants and the like are removed from the toner particles, (7) drying step in which the washed toner particles are dried, and (8) step of adding external additives into the dried toner particles.

Next, each of the steps will be described.

The individual steps are further detailed below.

(1) Dissolution/Dispersion Step:

This step comprises dissolving or dispersing toner particle constituent materials such as releasing agents and colorants in a polymerizable monomer to form a polymerizable monomer solution.

The releasing agents are added in such an amount that the content of the releasing agents falls within the foregoing range.

The polymerizable monomer solution may be added with an oil-soluble polymerization initiator and/or other oil-soluble components.

(2) Polymerization Step:

In a suitable embodiment of the polymerization step, the foregoing polymerizable monomer solution is added to an aqueous medium containing a surfactant at a concentration lower than the critical micelle concentration and mechanical energy is applied thereto to form oil-droplets, subsequently, polymerization is performed in the interior of the oil-droplets by radicals produced from a water-soluble polymerization initiator. Resin particles as nucleus particles may be added to the aqueous medium in advance.

Binder resin particles containing a releasing agent and a binder resin are obtained in the polymerization step. The obtained binder resin particles may or may not be colored. The colored binder resin particles can be obtained by subjecting a monomer composition containing a colorant to polymerization. In cases when using non-colored binder resin particles, a dispersion of colorant particles is added to a dispersion of binder resin particles, and the colorant particles and the binder resin particles are coagulated to obtain toner particles.

The aqueous medium refers to a medium that is composed mainly of water (at least 50% by weight). A component other than water is a water-soluble organic solvent. Examples thereof include methanol, ethanol, isopropanol, butanol, acetone, methyl ethyl ketone and tetrahydrofuran. Of these solvents, alcoholic organic solvents such as methanol, ethanol, isopropanol and butanol are specifically preferred.

Methods of dispersing a polymerizable monomer solution in an aqueous medium are not specifically limited, but dispersion by using mechanical energy is preferred. Dispersing machines to perform dispersion by using mechanical energy are not specifically limited, and examples thereof include a stirring apparatus equipped with a high speed rotor (CLEAR MIX, produced by M Technique Co., Ltd.), an ultrasonic homogenizer, a mechanical homogenizer, a Manton-Gaulin homomixer and a pressure type homogenizer. The dispersed particle preferably has a particle diameter of 10-1000 nm, and more preferably has a particle diameter of 30-300 nm.

(3) Coagulation/Fusion Step:

In the coagulation/fusion step, in cases when the binder resin particles are non-colored, a dispersion of colorant particles is added to the dispersion of binder resin particles, obtained in the foregoing polymerization step, and allowing the binder resin particles to be salted out, coagulated and fused with the colorant particles. In the course of the coagulation/fusion step, binder resin particles differing in resin composition may further be added to perform coagulation.

In the coagulation/fusion step, particles of internal additives such as a charge-controlling agent may be coagulated together with binder resin particles and colorant particles.

The coagulation/fusion is performed preferably in the following manner. To an aqueous medium including binder resin particle and colorant particles, a salting-out agent composed of alkali metal salts and/or alkaline earth metal salts is added as a coagulant at a concentration of more than the critical coagulation concentration and then heated at a temperature higher than the glass transition point of the binder resin particles and also higher than the melting peak temperature of a releasing agent used therein to perform salting-out concurrently with the coagulation/fusion.

In the coagulation/fusion step, it is necessary to perform prompt rise in temperature by heating and the temperature raising rate is preferably at least 1° C./min. The upper limit of the temperature raising rate is not specifically limited but is preferably not more than 15° C./ min terms of inhibiting formation of coarse particles due to a rapid progress of salting-out, coagulation and fusion.

After a dispersion of binder resin particles and colorant particles reaches a temperature higher than the glass transition point of the binder resin particles and also higher than the melting peak temperature of a releasing agent, it is essential to maintain that temperature of the dispersion over a given time to allow salting-out, coagulation and fusion. Thereby, growth of toner particles (coagulation of binder resin particles and colorant particles) and fusion (dissipation of interfaces between particles) effectively proceed, leading to enhanced durability of the toner.

A dispersion of colorant particles can be prepared by dispersing colorant particles in an aqueous medium. Dispersing colorant particle is performed at a surfactant concentration in water higher than the critical micelle concentration (CMC). Dispersing machines used for dispersing colorant particles are not specifically limited but preferred examples thereof include pressure dispersing machines such as an ultrasonic disperser, a mechanical homogenizer, a Manton-Gaulin homomixer or a pressure homogenizer, and a medium type dispersing machines such as a sand grinder, a Gettsman mil or a diamond fine mill.

The colorant particles may be those which have been subjected to surface modification treatments. Surface modification of the colorant particles is affected, for example, in the following manner. A colorant is dispersed in a solvent and thereto, a surface-modifying agent is added and allowed to react with heating. After completion of the reaction, the colorant particles are filtered off, washed with the same solvent and dried to produce surface-modified colorant particles.

(4) Ripening Step:

The ripening step is preferably conducted via thermal energy (heating).

Specifically, a system including coagulated particles is stirred with heating, while controlling the heating temperature, a stirring speed and heating rate until the shape of toner particles reaches the intended average circularity.

In the ripening step, the toner particles obtained above may be used as core particles and binder resin particles are further attached and fused onto the core particles to form a core/shell structure. In that case, the glass transition point of binder resin particle constituting the shell layer is preferably higher by at least 20° C. than that of binder resin particles constituting the core particles.

When binder resin particles used in the coagulation/fusion step are composed of a resin made from a polymerizable monomer containing an ionically dissociative group (hydrophilic resin) and a resin made from a polymerizable monomer containing no ionically dissociative group (hydrophobic resin), toner particles having a core/shell structure may be formed by disposing the hydrophilic resin on the surface side of the coagulated particle and the hydrophobic resin in the inside of the coagulated particle.

(5) Cooling Step:

This cooling step refers to a stage that subjects a dispersion of the foregoing toner particles to a cooling treatment (rapid cooling). Cooling is performed at a cooling rate of 1-20° C./min. The cooling treatment is not specifically limited and examples thereof include a method in which a refrigerant is introduced from the exterior of the reaction vessel to perform cooling and a method in which chilled water is directly supplied to the reaction system to perform cooling.

(6) Filtration/Washing Step:

In the filtration and washing step, a solid-liquid separation treatment of separating toner particles from a toner particle dispersion is conducted, then cooled to the prescribed temperature in the foregoing step and a washing treatment for removing adhered material such as a surfactant or salting-out agent from a separated toner particles (aggregate in a cake form) is applied.

In this step, washing is conducted until the filtrate reaches a conductivity of 10 μS/cm. A filtration treatment is conducted, for example, by a centrifugal separation, filtration under reduced pressure using a Nutsche funnel or filtration using a filter press, but the treatment is not specifically limited.

(7) Drying Step:

In this step, the washed toner cake is subjected to a drying treatment to obtain dried colored particles. Drying machines usable in this step include, for example, a spray dryer, a vacuum freeze-drying machine, or a vacuum dryer. Preferably used are a standing plate type dryer, a movable plate type dryer, a fluidized-bed dryer, a rotary dryer or a stirring dryer. The moisture content of the dried toner particles is preferably not more than 5% by weight, and more preferably not more than 2% by weight. When toner particles that were subjected to a drying treatment are aggregated via a weak attractive force between particles, the aggregate may be subjected to a pulverization treatment. Pulverization can be conducted using a mechanical pulverizing device such as a jet mill, a Henschel mixer, a coffee mill or a food processor.

(8) External Additive Addition Step:

In this step, the dried toner particles are optionally mixed with external additives. There are usable mechanical mixers such as a Henschel mixer and a coffee mill.

[Binder Resin]

Commonly known various resins, for example, vinyl resin such as styrene resin, (meth)acryl resin, styrene-(meth)acryl copolymer resin and olefinic resin, polyester resin, polyamide resin, polycarbonate resin, polyether resin, poly(vinyl acetate) resin, polysulfone resin, epoxy resin, polyurethane resin, and urea resin are used, as a binder resin constituting the toner of the present invention, in toner particles manufactured by a pulverization method or a solution suspension method. These resins can be used singly or in combination with at least two kinds.

In toner particles manufactured by a suspension polymerizationr a mini-emulsion polymerization coagulation method or an emulsion polymerization coagulation method, examples of a polymerizable monomer to obtain a resin forming the toner particles include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, and vinylidene fluoride; vinyl esters such as vinyl propionate, vinyl acetate, and vinyl benzoate; vinyl ethers such as vinyl methyl ether and vinyl ethyl ether; vinyl ketones such as vinyl methyl ketone, vinyl ethyl ketone, and vinyl hexyl ketone; N-vinyl compounds such as N-vinylcarbazole, N-vinylindole, and N-vinylpyrrolidone; vinyl compounds such as vinylnaphthalene and vinylpyridine; as well as derivatives of acrylic acid or methacrylic acid such as acrylonitrile, methacrylonitrile, and acryl amide. These vinyl based monomers may be employed singly or in combination with at least two kinds.

Further preferably employed as polymerizable monomers, which constitute the toner of the present invention, are those having ionic dissociative groups in combination, and include, for instance, those having substituents such as a carboxyl group, a sulfonic acid group, and a phosphoric acid group, as the constituting groups of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, and 3-chloro-2-acid phosphoxypropyl methacrylate.

Further, it is possible to prepare resins having a cross-linking structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, and neopentyl glycol diacrylate.

[Surfactant]

In manufacturing the toner particles of the present invention by the suspension polymerization method, a mini-emulsion polymerization coagulation method or emulsion polymerization coagulation method, surfactants used for obtaining a binder resin are not specifically limited but ionic surfactants described below are suitable. Such ionic surfactants include sulfonates (e.g, sodium dodecylbenzene sulfonate and sodium arylalkylpolyether sulfonate), sulfates (e.g., sodium dodecyl sulfate, sodium tetradecyl sulfate, sodium pentadecyl sulfate and sodium octyl sulfate), and fatty acid salts (e.g., sodium oleate, sodium laurate, sodium caprate, sodium caprylate, sodium caproate, potassium stearate and calcium oleate). Nonionic surfactants are also usable, and examples thereof include polyethylene oxide, polypropylene oxide, a combination of polypropylene oxide and polyethylene oxide, an ester of polyethylene glycol and a higher fatty acid, alkylphenol polyethylene oxide, an ester of polypropylene oxide and a higher fatty acid, and sorbitan ester. These surfactants are used as an emulsifying agent when manufacturing the toner by an emulsion polymerization method but may also be used in other processes or for other purposes.

[Polymerization Initiator]

In the case of manufacturing the toner particles of the present invention by a suspension polymerization method, a mini-emulsion polymerization coagulation method or an emulsion polymerization coagulation method, a binder resin can be polymerized employing radical a polymerization initiator.

Specifically, oil-soluble radical polymerization initiators are usable in suspension polymerization and examples of an oil-soluble polymerization initiator include azo- or diazo-type polymerization initiators, e.g., 2,2'-azobis-(2,4-dimethylvaleronitrile), 2,2'-azobisisobutylonitrile, 1,1'-azobis(cyclohexane-1-carbonitrile), 2,2'-azobis-4-methoxy-2,4-dimethylvaleronitrile, azobisisobutylonitrile; peroxide type polymerization initiators, e.g., benzoyl peroxide, methyl ethyl ketone peroxide, diisopropylperoxycarbonate, cumene hydroperoxide, t-butyl hyroperoxide, di-t-butyl peroxidedicumyl peroxide, 2,4-dichlorobenzoyl peroxide, lauroyl peroxide, 2,2-bis-(4,4-t-butylperoxycyclohexyl)-propane, tris-(t-butylperoxy)triazine; and polymeric initiators having a side-chain of peroxide.

Water-soluble radical polymerization initiators are usable in an emulsion polymerization method or emulsion polymerization coagulation method. Examples of a water-soluble polymerization initiator include persulfates such as potassium persulfate and ammonium persulfate; azobisaminodipropane acetic acid salt, azobiscyanovaleric acid and its salt, and hydrogen peroxide.

[Chain Transfer Agent]

In manufacturing the toner particles of the present invention by the suspension polymerization method, a mini-emulsion polymerization coagulation method or an emulsion polymerization coagulation method, generally used chain-transfer agents are usable for the purpose of controlling the molecular weight of a binder resin.

Chain transfer agents are not specifically limited but examples thereof include mercaptans such as n-octylmercaptan, n-decylmercaptane and tert-dodecylmercaptan; n-octyl-3-mercaptopropionic acid ester, terpinolene, carbon tetrabromide, carbon and α-methylstyrene dimmer.

[Colorant]

Commonly known inorganic or organic colorants are usable for the toner of the present invention. Specific colorants are as follows.

Examples of black colorants include carbon black such as Furnace Black, Channel Black, Acetylene Black, Thermal Black and Lamp Black and magnetic powder such as magnetite and ferrite.

Further, examples of magenta and red colorants include C.I. Pigment Red 2, C.I. Pigment Red 3, C.I. Pigment Red 5, C.I. Pigment Red 16, C.I. Pigment Red 48, C.I. Pigment Red 53, C.I. Pigment Red 57, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Examples of orange or yellow colorants include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 74, C.I. Pigment Yellow 93, C.I. Pigment Yellow 94, C.I. and Pigment Yellow 138.

Examples of green or cyan colorants include C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66 and C.I. Pigment Green 7.

The foregoing colorants may be used singly or in combination with at least two kinds.

The colorant content is preferably from 1-30% by weight, and more preferably 2-20% by weight.

Surface-modified colorants are also usable. Commonly known surface modifiers are usable and preferred examples thereof include a silane coupling agent, a titanium coupling agent and an aluminum coupling agent.

[Coagulant]

Coagulants usable in manufacturing the toner particles of the present invention by a mini-emulsion polymerization coagulation method or an emulsion polymerization coagulation method, in order to obtain a binder resin, include alkali metal salts and alkaline earth metal salts. Examples of alkali metals constituting a coagulant include lithium, sodium and potassium; examples of alkaline earth metals constituting a coagulant include magnesium, calcium, strontium and barium. Of these, potassium, sodium, magnesium, calcium and barium are preferable. Examples of counter-ions for the alkali metal or the alkaline earth metal (anion constituting a salt) include chloride ion, bromide ion, iodide ion, carbonate ion and sulfate ion.

[Charge Controlling Agent]

The toner particles of the present invention may optionally contain a charge controlling agent. Charge controlling agents usable in the present invention include various compounds known in the art.

[Particle Diameter of Toner Particle]

The toner particles of the present invention preferably have a number-based median particle diameter ($D_{50}$) of 3-8 μm. In manufacturing toner particles by the polymerization methods described earlier, the particle diameter can be controlled by a coagulant concentration, the addition amount of organic solvents, a fusion time and polymer composition.

A number-based median particle diameter ($D_{50}$) falling within the range of 3-8 μm not only can achieve reproduction of fine lines and enhanced image quality of photographic images but also can reduce toner consumption in comparison to the case of employing a toner having a larger particle diameter.

[Average Circularity of Toner Particle]

Each of toner particles constituting toner of the present invention exhibits an average circularity of 0.930-1.000, and preferably an average circularity of 0.950-0.995 in view of improvement of a transfer efficiency. The average circularity is represented by the following equation (2).

Average circularity=(circumference length of a circle having an area equivalent to the projected area of a particle)/(circumference length of a projected image of a particle) Equation (2)

[External Additives]

In order to improve flowability, a charging property and cleaning performance, so-called external additives may be added into the toner. External additives are not specifically limited and a variety of inorganic particles, organic particles and lubricants are usable as external additives.

Inorganic oxide particles such as silica, titania, alumina and the like are preferably used as inorganic particles. The inorganic particles may be surface-treated preferably by using a silane coupling agent, titanium coupling agent and the like to enhance hydrophobicity. Spherical organic particles having an number average primary particle diameter of 10-2000 nm are also usable. Polystyrene, polymethyl methacrylate, a styrene-methyl methacrylate copolymer and the like are usable as organic particles.

External additives are incorporated into the toner in an amount of 0.1-0.5% by weight, and preferably 0.5-4.0% by weight. External additives may be incorporated singly or in combination.

The toner of the present invention may be used as a magnetic or nonmagnetic single component developer or as a two-component developer together with a carrier. To be more concrete, in cases when the toner is used as a single component developer, a nonmagnetic single component developer and a magnetic single component developer which contains magnetic particles of 0.1-0.5 μm in size in the toner are cited and both are usable. In cases when the toner is used as a two-component developer, magnetic particles composed of metals such as iron, ferrite or magnetite, or alloys of the foregoing metals and aluminum or lead are usable as a carrier, and of these, ferrite particles are specifically preferable. There may also be used a coat carrier of resin-coated magnetic particles and a resin dispersion type carrier in which a fine-powdery magnetic material is dispersed in a binder resin.

Coating resins used for the coat carrier are not specifically limited and examples thereof include olefin based resin, styrene based resin, styrene-acryl based resin, silicone based resin, ester resin and fluorine-containing polymer based resin. Resins constituting the resin dispersion type carrier are not specifically limited, and commonly known resins are usable, such as styrene-acryl based resin, polyester resin, fluorine resin and phenol resin. A coat carrier coated with styrene-acryl based resin is cited as a preferred carrier in terms of preventing external additives from being released and durability.

The volume-based particle median particle diameter ($D_{50}$) of carrier particles is preferably 20-100 μm, and more preferably 25-80 μm. The volume-based median particle diameter ($D_{50}$) of the carrier particles can be determined using a laser diffraction type particle size distribution measurement apparatus equipped with a wet disperser, HELOS (manufactured by SYMPATEC Corp.).

(Fixing Device)

The fixing device employed in an image forming method of the present invention is a contact heating fixing device fitted with a heating roller and a belt-shaped pressure body, and the heating roller is placed on the unfixed toner image side.

"On the unfixed toner image side" means "on the unfixed toner image side of a transfer material", and conventionally "on the upper side of the transfer material when inserting the transfer material, on which unfixed toner images are formed, into the fixing device.

This contact heating fixing device can take a longer duration to supply heat for fixing into the toner and the transfer material since a wide nip portion can be formed with the heating roller and the belt-shaped pressure body, and exhibits excellent fixing efficiency.

It is preferable that the heating roller preferably exhibits heat resistance since it is heated by a heating member, and exhibits a good releasing property with respect to the melted toner. Specifically, provided can be one having a heating source inside a metal cylinder composed of iron, aluminum or such, of which surface is covered with a tetrafluoroethylene, polytetrafluoroethylene-perfluoroalkoxy vinyl ether copolymer and so forth.

As a belt-shaped pressure body, a seamless belt is preferably employed, and the seamless belt preferably exhibits heat resistance, flexibility, and a releasing property. Specific examples of the seamless belt include one having a layered structure formed from silicone rubber elastic layers and a PFA (perfluoroalkoxy) outer surface layer provided on a polyimide substrate, and one having a layered structure obtained by coating a releasing layer, in which a conductive material is added into a fluorine resin, on a polyester substrate, a polyperfluoroalkyl vinyl ether substrate, a polyimide substrate or a polyetherimide substrate.

Incidentally, the nip portion preferably has a width of 5-40 mm, and more preferably has a width of 10-30 mm.

FIG. 1 is an illustrative diagram showing an example of a contact heating fixing device fitted with a heating roller and s seamless belt employed in the present invention.

Numerals 10, 11, 12*a*, 12*b*, 40 and N represent a heating roller, a seamless belt, a pressure pad (pressure member), a pressure pad (pressure member), a lubricant supplying member and nip width, respectively.

Heating roller 10 comprises heat resistant elastic body layer 10*b* and releasing layer (heat resistant resin layer) 10*c* which are formed around a metal core (cylindrical core metal) 10*a*, wherein inside core 10*a* is provided with halogen lamp 14 as a heat source. The surface temperature of seamless belt 11 is measured with temperature sensor 15, and halogen lamp 14 is feedback-controlled by an unshown temperature controller in response to the measured signal, whereby the surface temperature of seamless belt 11 is adjusted so as to give a predetermined temperature. Seamless belt 11 is in contact so as to be wound by a given angle with respect to heating roller 11 to form nip width N.

On the inner side of seamless belt 11, provided is pressure pad 12 having a low friction layer on the surface in the situation of being pressed against heating roller 10 via seamless belt 11. Pressure pad 12 comprises pressure pad 12*a* to which a strong nip pressure is applied and pressure pad 12*b* to which a weak nip pressure is applied, and is supported by holder 12*c* made of metal or such.

Holder 12*c* is further fitted with a belt-travel guide in such a way that seamless belt 11 can slide and rotate smoothly. Accordingly, the belt-travel guide is preferably formed from a member having lower friction coefficient because of rubbing against the inner surface of seamless belt 11, and may also be formed from a member having low heat conductivity so as not to take the heat away easily.

Heating roller 10 is rotated in the direction of arrow B by an unshown motor, and seamless belt 11 is also rotated according to the rotation. Toner image 17 is transferred onto transfer material P by an unshown transferring device, and transfer material P is conveyed to the nip portion (in the direction of arrow A) from the right side of the drawing. Toner image 17 on transfer material P is fixed by pressure applied to the nip portion and heat given by halogen lamp 14 via heating roller 10. When fixing is performed by the device composed of a structure shown in FIG. 1, fixing performance can be stably and efficiently obtained since a wider nip portion can be employed.

Transfer material P after fixing is suitably peeled without twining around heating roller 10 by the effects of releasing layer 10*c* and distortion at the nip portion, but it is desirable that peeling device 20 as a auxiliary peeling device is provided at a downstream position of the nip portion in the rotating direction of heating roller 10. Peeling device 20 is supported by guide 20*b* so that peeling sheet 20*a* comes in contact with heating roller 10 in the reverse direction with respect to the rotating direction of heating roller 10.

Next, each of parts will be described in detail. For core 10*a*, a cylindrical body made of metal exhibiting high heat conductance such as iron, aluminum and stainless steel can be employed. The outer diameter and the thickness of core 10*a* in a fixing device of the present invention may be small since the pressure of pressure pad 12 is small. Specifically, one having an outer diameter of 20-35 mm and a thickness of 0.3-0.5 mm can be employed in the case of an iron core. The size of the core, of course, may be suitably decided since the strength and the heat conductance depend on a utilized material.

Any material can be employed for the heat resistant elastic body layer 10*b* as long as the material is an elastic body exhibiting high heat resistance. Particularly, an elastic substance such as rubber and elastomer having a rubber hardness of 25-40° (JIS-A) is preferable. Specifically, silicone rubber and fluorine rubber are usable. Heat resistant elastic body layer 10*b* preferably has a thickness of 0.3-1.0 mm, depending on the rubber hardness of the utilized material.

In the fixing device of the present invention, the total loading by pressure pad 12 can be reduced and a thinner heat resistant elastic body layer 10*b* can be produced since the sufficient fixation can be obtained by the large nip width and the peeling can be effectively conducted via small distortion. As mentioned above, a small outer diameter and a thinner thickness of core 10*a* of a fixing device of the present invention can be produced, and a thinner thickness of heat resistant elastic body layer 10*b* formed on the surface of core 10*a* can also be produced. Therefore, the instant starting ability is improved and/or the output of halogen lamp 14 as a heat source can be lowered since the fixing device exhibits extremely lower heat capacity in comparison to a conventional roller-paired type fixing device. Moreover, heat resistance between the inner surface and the outer surface of heating roller 10 can be lowered so that the thermal response can be raised. Accordingly, the electric power consumption can be reduced and high-speed fixation becomes possible.

For releasing layer (heat resistant resin layer) 10*c* to be formed on heat resistant elastic body layer 10*b*, any resin may be employed as long as those are a heat resistant resin, and examples thereof include a fluorine resin and a silicone resin. The fluorine resin is preferably employed in view of a releasing property and wear resistance. A fluorine resin such as PFA (perfluoroalkyl vinyl ether copolymer resin), PTFE (polytetrafluoroethylene) or FEP (tetrafluoroethylene-hexafluoropropylene copolymer resin) is usable, but PFA is most suitably usable in view of heat resistance and the workability. Releasing layer 10*c* preferably has a thickness of 5-30 μm, and more preferably has a thickness of 10-20 μm. In the case of releasing layer 10*c* having a thickness of less than 5 μm, wrinkles caused by distortion of heating roller 10 are possibly generated. On the other hand, in the case of the thickness exceeding 30 μm, releasing layer 10*c* becomes hard, whereby image quality defects such as unevenness in glossiness tend to appear. Both cases are undesirable. Any of known methods can be applied to form releasing layer 10*c*, and examples thereof include a dipping coating method, a spray coating method, a roller coating method and a spin coating method.

Seamless belt 11 is preferably composed of a base layer and a releasing layer coated on the surface (surface brought into contact with heating roller 10 or both surfaces) of the base layer. The base layer is one selected from the group consisting of polyimide, polyamide and polyamideimide, and the layer preferably has an approximate thickness of 50-125 μm, and more preferably has an approximate thickness of 75-100 μm. The releasing layer provided on the surface of the base layer is preferably formed by coating the foregoing fluorine resin such as PFA having a thickness of 5-20 μm.

The winding angle of seamless belt 11 with respect to heating roller 10 is preferably 20°-45° so as to give sufficiently wide width of the nip portion, though depending on the rotation speed of heating roller 10. Further, the winding angle is preferably adjusted in such a way that the duel time (passing time of a transfer material) at the nip portion is at least 30 msec, and particularly 50-70 msec. The wide width of the nip portion can be produced, and the fixing property and the releasing property of toner can be improved by using seamless belt 11 capable of driving while following the shape of heating roller 10.

As a basic structure of pressure pad 12, pressure pad 12*a* with low pressure to acquire a wide width nip portion is placed on the entrance side, and pressure pad 12*b* to obtain high nip pressure against heating roller 10 is placed on the exit side of the nip portion. In addition, as a basic structure of pressure pad 12, pressure pad 12*a* is placed on the upstream side of the nip portion in order to acquire a wide width nip portion, and pressure pad 12*b* is placed on the downstream side of the nip portion in order to acquire nip pressure against heating roller 10. It is preferable that the relationship between pressure X of pressure pad 12*a* and pressure Y of pressure pad 12*b* satisfies X<Y. In the case of the relationship satisfying X<Y, heat resistant elastic layer 10*b* of heating roller 10 can be locally deformed around the downstream area of the nip portion, whereby transfer material P is to warp against the heating roller, and is difficult to wind around the heating roller, resulting in improving separation performance with the heating roller. X is preferably 300-500 N, Y is preferably 400-600 N, and it is preferable that the relationship between X and Y satisfies X<Y. A low friction layer is provided on the surface where pressure pads 12*a* and 12*b* are brought into contact with seamless belt 11 in order to reduce rubbing resistance between the circumferential surface of seamless belt 11 and pressure pad 12.

A lubricant may be allowed to be supplied between the surface of pressure pad 12 and the inner surface of seamless belt 11. For example, silicone oil, fluorinated oil and grease are usable. This lubricant is coated on the inner surface of the belt, but one exhibiting a releasing property is preferable since the lubricant possibly adheres to the heating roller by flowing around seamless belt 11. The silicone oil is more preferable than the fluorine oil in consideration of a safety problem.

Examples of the silicone oil include dimethyl silicone oil, amino-modified silicone oil, carboxyl-modified silicone oil, silanol-modified silicone oil, and sulfonic acid-modified silicone oil. Of these, amino-modified silicone oil having a viscosity of 500-10,000 cs is preferable in view of handling suitability and the situation where a starting torque and a driving torque of the image fixing device can be effectively maintained in the desired low range. The foregoing lubricant is not basically consumed, but it might be gradually reduced and run out by using during a long duration via the foregoing flowing around. In this case, torque is increased. Accordingly, in the present invention, the fixing device is equipped with lubricant supplying member 40 to hold and supply the lubricant by an amount equivalent to life of the fixing device so as to run out the lubricant.

Lubricant holding member 41 for lubricant supplying member 40 is preferably one having many continuous pores together with heat resistance and appropriate elastic modulus at the fixing temperature, and examples thereof include felt and sponge. Lubricant permeation amount regulating film 42 for lubricant supplying member 40 is also preferably one having many continuous pores, heat resistance at the fixing temperature and a low frictional coefficient. For example, one molded by stretching a resin exhibiting heat resistance and a low frictional coefficient is preferable. A film molded by stretching a fluorine resin is more preferable.

Lubricant holding member 41 is impregnated with the lubricant, and the lubricant permeation amount regulating member 42 for lubricant supplying member 40 is brought into contact with almost the entire range in the axis direction of the seamless belt. The lubricant is supplied into the entire inner circumferential surface of seamless belt 11 via rotation of seamless belt 11. A large supply amount of lubricant is not needed. Accordingly, the contact-pressure of lubricant supplying member 40 against seamless belt 11 is small, and the slight contact-pressure may be preferred.

It is desired that a very small amount of lubricant is continuously supplied onto the inner circumferential surface of seamless belt 11. The amount of lubricant supplied to the inner circumferential surface of seamless belt 11 is controlled by regulating the permeation amount of lubricant through lubricant permeation amount regulating member 42 via variation of a pore ratio in porous lubricant permeation amount regulating member 42.

It is desirable in lubricant supplying member 40 that the supply amount around the central portion in the axis direction of seamless belt 11 is larger than that around both ends of seamless belt 11. Such the situation can be accomplished by making the contact width of lubricant supplying member 40 around the central portion of seamless belt 11 wider than that around the edge portion, or making the contact-pressure of lubricant supplying member 40 around the central portion of seamless belt 11 stronger than that around the end portion. The supply amount is increased by making the contact width of lubricant supplying member 40 at the central portion wider than that at the end portion. This influences occurrence of wrinkles during rotation of seamless belt 11. In the case of a high belt speed at the central portion, no winkle of the belt is generated, but wrinkles of the belt tend to occur when the belt speed at the central portion is lower than that at the end portion. Therefore, the supply amount of lubricant is increased at the central portion, whereby easy traveling performance is obtained at the central portion to inhibit occurrence of wrinkles.

Lubricant supplying member 40 is attached onto the outer surface of a belt-travel guide and slightly touched to the inner circumferential surface of seamless belt 11. Lubricant supplying member 40 is placed around the entrance of the nip portion. On the entrance side of the nip portion, a force pushing the belt to the travel-guide is caused via rotation of seamless belt 11. Accordingly, the belt can be pressed without deviation by providing lubricant supplying member 40 at this position.

(Image Forming Method)

An image forming method in the present invention includes the steps of transferring a toner image onto a transfer material after developing a latent image formed on a photoreceptor with a developer containing the toner of the present invention to visualize the image; and thermally fixing the transferred toner image onto the transfer material employing a contact heating fixing device.

In order to obtain print images, the image forming method specifically includes the steps of forming a toner image visualized via a developing method employing two-component component developer in which a toner and a carrier are mixed; transferring this toner image onto a transfer material via application of a transfer electric field; and fixing the toner image transferred onto the transfer material employing a contact heating fixing device comprising a heating roller and a seamless belt.

Figure 2:
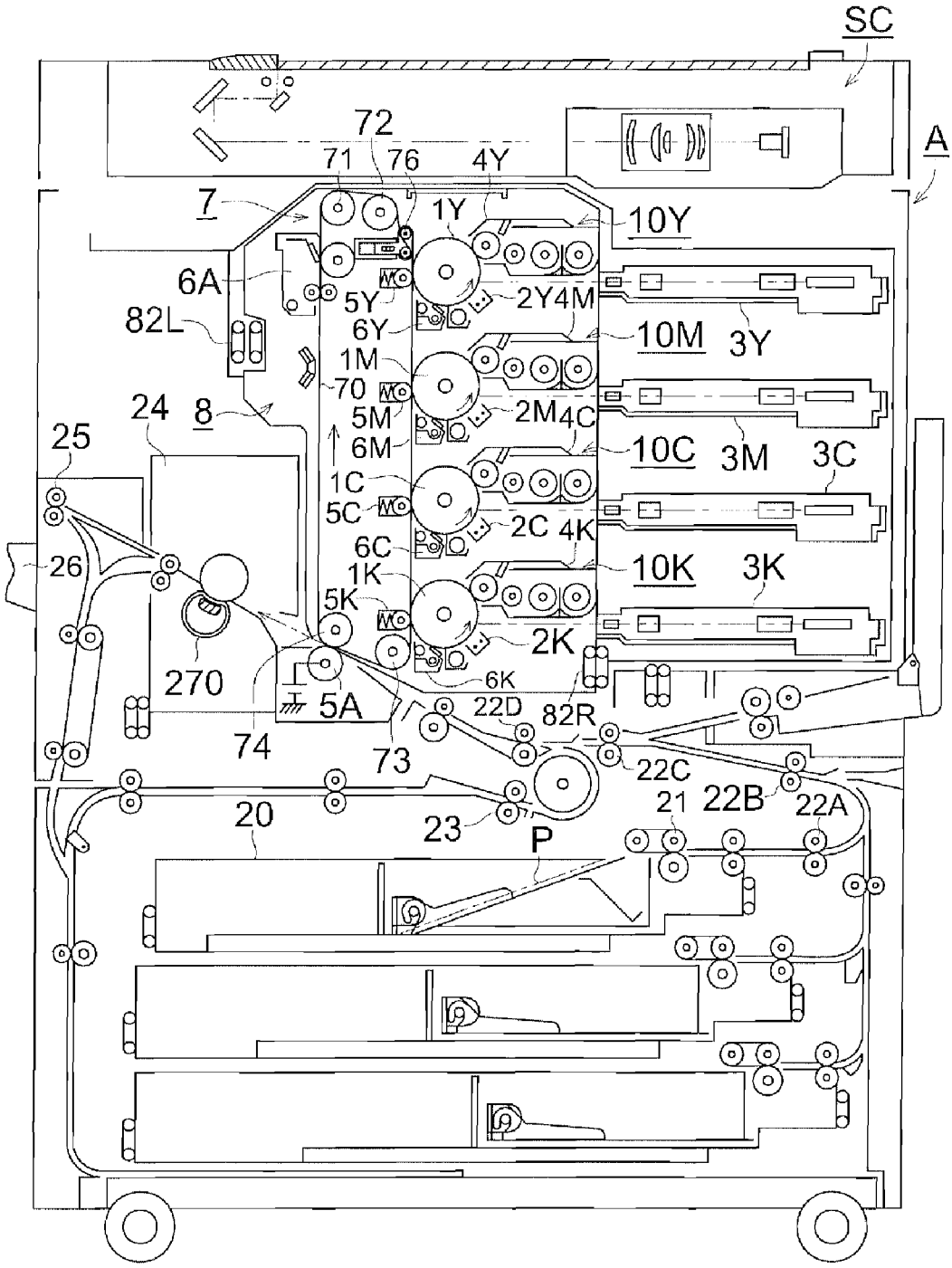
FIG. 2 is a cross-sectional schematic diagram showing an example of an image forming apparatus employed in the image forming method of the present invention.

FIG. 2 is a cross-sectional schematic diagram showing an example of an image forming apparatus employed in the image forming method of the present invention.

In FIG. 2, 1Y, 1M, 1C and 1K each represent a photoreceptor, 4Y, 4M, 4C and 4K each represent a developing device, 5Y, 5M, 5C and 5K each represent a primary transfer roller as a primary transfer device, 5A represents a secondary transfer roller as a secondary transfer device, 6Y, 6M, 6C and 6K each represent a cleaning device, 7 represents an intermediate transfer belt unit, 24 represents a contact-heating fixing device, and 70 represents an intermediate transfer belt.

This image forming apparatus called a tandem type color image forming apparatus comprises a plurality of image forming sections 10Y, 10M, 10C, and 10K, endless-belt-shaped intermediate transfer belt unit 7, endless-belt-shaped sheet convey device 21 to convey transfer material P, and contact-heating heating fixing device 24 equipped with belt-shaped heater 270 as fixing device 24. Document image reading device SC fitted with a polygon mirror is placed on main body A of the image forming apparatus.

Image forming section 10Y forming the yellow image as one toner image out of different colors formed on each photoreceptor comprises drum-shaped photoreceptor 1Y as the first photoreceptor, charging device 2Y placed around the photoreceptor 1Y, exposure device 3Y, developing device 4Y, primary transfer roller 5Y as a primary transfer device, and cleaning device 6Y. Image forming section 10M forming the magenta image as one toner image of another different color comprises drum-shaped photoreceptor 1M as the first photoreceptor, charging device 2M placed around the photoreceptor 1M, exposure device 3M, developing device 4M, primary transfer roller 5M as a primary transfer device, and cleaning device 6M. The image forming section 10C forming the cyan image further as one toner image of another different color comprises drum-shaped photoreceptor 1C as the first photoreceptor, charging device 2C placed around the photoreceptor 1C, exposure device 3C, developing device 4C, primary transfer roller 5C as a primary transfer device, and cleaning device 6C. Image forming section 10K forming the black image further as one toner image of another different color comprises drum-shaped photoreceptor 1K as the first photoreceptor, charging device 2K placed around the photoreceptor 1K, exposure device 3K, developing device 4K, primary transfer roller 5K as a primary transfer device, and cleaning device 6K.

Endless-belt-shaped intermediate transfer belt unit 7 is windingly wound with a plurality of rollers, and has endless-belt-shaped intermediate transfer belt 70 as an intermediate transfer endless-belt-shaped second image carrier arranged to be capable of rotation.

Each color images formed by image forming sections 10Y, 10M, 10C, and 10K are sequentially transferred onto rotating endless-belt-shaped intermediate transfer belt 70 by primary transfer rollers 5Y, 5M, 5C, and 5K so that a composite color image is formed. Transfer material P of a sheet as a transfer material received in sheet feeding cassette 20 is fed by sheet feeding device 21, conveyed to secondary transfer roller 5A as a secondary transfer device through a plurality of intermediate rollers 22A, 22B, 22C, 22D, and registration roller 23, and then, the color image is secondarily transferred onto transfer material P all at once. Transfer material P on which the color image has been transferred is fixed by contact-heating fixing device 24, sandwiched by paper-ejection roller 25, and mounted on paper-ejection tray 26 outside the machine.

On the other hand, after the color image has been transferred onto transfer material P by secondary transfer roller 5A, residual toner is removed from endless-belt-shaped intermediate transfer belt 70, from which transfer material P has self-striped, with cleaning device 6A.

During image forming processing, primary transfer roller 5K is constantly pressed against photoreceptor 1K. Other primary transfer rollers 5Y, 5M, and 5C are pressed against photoreceptors 1Y, 1M, and 1C, respectively only during color image formation.

Secondary transfer roller 5A is pressed against endless-belt-shaped intermediate transfer belt 70 only when transfer material P passes through here and the secondary transfer is carried out.

Enclosure 8 is capable of being drawn out of apparatus main body A guided by supporting rails 82L and 82R.

Enclosure 8 comprises image forming sections 10Y, 10M, 10C, 10K and endless-belt-shaped intermediate transfer belt unit 7.

Image forming sections 10Y, 10M, 10C, and 10K are disposed vertically in alignment. Endless-belt-shaped intermediate transfer belt unit 7 is disposed on the left side, in the figure, of photoreceptors 1Y, 1M, 1C, and 1K. Endless-belt-shaped intermediate transfer belt unit 7 comprises endless-belt-shaped intermediate transfer belt capable of rotation by winding rollers 71, 72, 73, 74 and 76, primary transfer rollers 5Y, 5M, 5C and 5K, and cleaning device 6A.

Image forming sections 10Y, 10M, 10C, and 10K, and endless-belt-shaped intermediate transfer belt unit 7 are pulled out of main body A in an integrated manner via pulling-out operation of enclosure 8.

In this way, toner images are formed on photoreceptors 1Y, 1M, 1C and 1K via electrification, exposure and development, toner images of each color are superimposed on endless-belt-shaped intermediate transfer belt 70 to be transferred into transfer material P all at once, and to be subsequently fixed via applied pressure and heating by contact-heating fixing device 24. As to photoreceptors 1Y, 1M, 1C and 1K after transferring toner images into transfer material P, toner remaining on the photoreceptors is cleaned during transfer employing cleaning device 6A, and a cycle of the above-described electrification, exposure and development is subsequently carried out to conduct the next image formation.

<Transfer Material>

The transfer material used in the present invention is a support for keeping the toner image conventionally called as an image support, a transfer material or a transfer sheet. Specific examples of various types of the transfer material include plain papers from thin paper to thick paper; fine-quality paper; printing paper such as art paper and coated paper; commercially available Japanese paper and postcard paper; plastic film for OHP; and cloth, but the transfer material is not limited thereto.

EXAMPLE

Next, the present invention will be explained employing examples, but the present invention is not limited thereto.

<<Preparation of Toner>>

Toner was prepared in the following procedure.

The prepared releasing agent composition, the material, the number of carbon atoms ($R^1$-$R^2$), the branching ratio of hydrocarbon compounds, the melting point and the molecular weight are shown in Table 1. Incidentally, releasing agents 7-10 are refined by separating petroleum vacuum distillation residual oil or raw oil of heavy distillates with a solvent extraction method.

TABLE 1

| Releasing agent No. | Releasing Agent Composition | Material | Number of carbon atoms ($R^1$-$R^2$) | Branching ratio of hydrocarbon compound | Melting Point (° C.) | Molecular weight |
|---|---|---|---|---|---|---|
| 1 | Monoester compound | Formula (a) | 13-14 | — | 41 | — |
| 2 | Monoester compound | Formula (c) | 17-18 | — | 58 | — |
| 3 | Monoester compound | Formula (f) | 21-22 | — | 71 | — |
| 4 | Monoester compound | Formula (h) | 29-30 | — | 92 | — |
| 7 | Hydrocarbon compound | — | — | 0.1 | 75 | 700 |
| 8 | Hydrocarbon compound | — | — | 0.3 | 80.2 | 640 |
| 9 | Hydrocarbon compound | — | — | 0.4 | 80 | 600 |
| 10 | Hydrocarbon compound | — | — | 1.0 | 81 | 550 |
| 15 | Monoester compound | Lacceric acid ester | 31-2 | — | 76 | — |
| 16 | Monoester compound | Laurylic acid ester | 11-12 | — | 27 | — |

<Preparation of Toner 1>

[Preparation of Resin Particle Dispersion A]

(The 1st Step Polymerization)

A solution in which 8 parts by weight of dodecyl sodium sulfate were dissolved in 3000 parts by weight of ion-exchange water was charged in a reaction vessel fitted with a stirring device, a temperature sensor, a cooling tube and a nitrogen introducing device, and the inner temperature was raised up to 80° C. while stirring at a stirring speed of 230 rpm under the nitrogen flow. After the raised temperature, a solution in which 10 parts by weight of potassium persulfate were dissolved in 200 parts by weight of ion-exchange water was added into the system, and the liquid temperature was again set to 80° C. to drip a polymerizable monomer solution containing 480 parts by weight of styrene, 250 parts by weight of n-butylacrylate, 68.0 parts by weight of methacrylic acid and 16.0 parts by weight of n-octyl-3-mercaptopropionate, spending one hour. Subsequently, the system was heated at 80° C. for 2 hours while stirring, and polymerization was conducted to prepare resin particle dispersion (1H) containing resin particle (1h).

(The 2nd Step Polymerization)

A solution in which 7 parts by weight of polyoxyethylene-2-dodecyl ether sodium sulfate were dissolved in 800 parts by weight of ion-exchange water was charged in a reaction vessel fitted with a stirring device, a temperature sensor, a cooling tube and a nitrogen introducing device. After heating the system to 98° C., a polymerizable monomer solution in which 245 parts by weight of styrene, 120 parts by weight of n-butylacrylate, 1.5 parts by weight of n-octyl-3-mercaptopropionate, 64 parts by weight of releasing agent No. 1, 96 parts by weight of releasing agent No. 7 in FIG. 1, together with 260 parts by weight of the above-described resin particle dispersion (1H) were dissolved at 90° C. was added into the system, and mixed while dispersing for one hour employing a mechanical homogenizer CLEARMIX (manufactured by M-Technique Co., Ltd.) having a circulation path to prepare a dispersion containing emulsified particles (oil droplets).

Next, a initiator solution in which 6 parts by weight of potassium persulfate were dissolved in 200 parts by weight of ion-exchange water was added into this dispersion, and this system was polymerized at 82° C. while stirring for one hour to prepare resin particle dispersion (1HM) containing resin particle (1hm).

(The 3rd Step Polymerization)

A solution in which 11 parts by weight of potassium persulfate were dissolved in 400 parts by weight of ion-exchange water was added into the above-described resin particle dispersion (1HM), and a polymerizable monomer solution containing 435 parts by weight of styrene, 130 parts by weight of n-butylacrylate, 33 parts by weight of methacrylic acid and 8 parts by weight of n-octyl-3-mercaptopropionate was dripped at 82° C., spending one hour. After completion of dripping, a polymerization treatment was conducted while heating and stirring for two hours, and the system was subsequently cooled down to 28° C. to obtain resin particle dispersion A containing resin particle a. When the particle diameter of resin particles in the resulting resin particle dispersion A was measured employing an electrophoretic light scattering photometer ELS-800 (manufactured by Otsuka Electronics Co., Ltd.), it was 150 nm in volume-based median diameter. Further, the measured glass transition temperature of the resin particles was 45° C.

[Preparation of Colorant Particle Dispersion Q]

While stirring, 420 parts by weight of C.I. pigment blue 15; 3 were gradually added into a solution in which 90 parts by weight of dodecyl sodium sulfate were dissolved in 1600 parts by weight of ion-exchange water, and a dispersion treatment was subsequently conducted employing a mechanical homogenizer CLEARMIX (manufactured by M•Technique Co., Ltd.) to prepare colorant particle dispersion Q. When the particle diameter of colorant particles in the resulting colorant particle dispersion Q was measured employing an electrophoretic light scattering photometer ELS-800 (manufactured by Otsul,a Electronics Co., Ltd.), it was 110 nm in volume-based median diameter.

[Preparation of Toner Particle 1]

A solution in which 300 parts by weight of resin particle dispersion A in solid content conversion, 1400 parts by weight of ion-exchange water, 120 parts by weight of colorant particle dispersion Q and 3 parts by weight of polyoxyethylene-2-dodecylether sodium sulfate were dissolved in 120 parts by weight of ion-exchange water was charged in a reaction vessel fitted with a stirring device, a temperature sensor, a cooling tube and a nitrogen introducing device, and after the liquid temperature was set to 30° C., and pH was adjusted to 10 by adding an aqueous 5N sodium hydroxyide solution. Subsequently, an aqueous solution in which 35 parts by weight of magnesium chloride were dissolved in 35 parts by weight of ion-exchange water was added into the system at 30° C. for 10 minutes while stirring, and after standing for 3 minutes, the system was raised to 90° C. spending 60 minutes to continue the particle growth reaction keeping the temperature at 90° C. In this situation, the particle diameter of coagulated particles was measured with "Coulter Multisizer 3" (manufactured by Coulter Co., Ltd.), and when reaching the desired particle diameter, an aqueous solution in which 150 parts by weight of sodium chloride were dissolved in 600 parts by weight of ion-exchange water was added to terminate the particle growth. Further, inter-particle fusion was accelerated until reaching an average circularity of 0.965 via measurement employing "FPIA-2100" (manufactured by Sysmex Corporation) by conducting a ripening step at a liquid temperature of 98° C. while stirring, and a hydrophilic resin was oriented onto the coagulated particle surface while a hydrophobic resin was oriented on the inner side of the coagulated particle to form toner particles having a core-shell structure. After this, the system was cooled down to 30 ° C., pH was adjusted to 4.0 by adding hydrochloric acid, and stirring was terminated.

Toner particles prepared in the above-described process were solid/liquid-separated by a basket type centrifugal separator "Mark III type No. 60×40" manufactured by Matsumoto Kikai Mfg. Co. Ltd. to produce a toner particle wet cake. This wet cake was washed in ion-exchange water at 45° C. employing the foregoing basket type centrifugal separator until the separated liquid reached 5 μS/cm in electrical conductivity, and then moved to "Flash Jet Dryer" produced by Seishin Enterprise Co., Ltd. and dried until the moisture content reached 0.5% by weight to prepare "toner particle 1".

Into this "toner particle 1", 1% by weight of hydrophobic silica (a number average primary particle diameter of 12 nm) and 0.3% by weight of hydrophobic titania (a number average primary particle diameter of 20 nm) were added, and the system was mixed with a Henschel mixer to prepare "Toner 1".

Incidentally, with respect to toner particle 1, no change in shape and particle diameter was obtained via addition of hydrophobic silica or hydrophobic titanium oxide.

Toners 2-8 were prepared similarly to preparation of Toner 1, except that the releasing agent and the content in the 1st releasing agent component, the releasing agent and the content in the 2nd releasing agent component and the releasing agent addition amount, which were utilized in preparation of Toner 1, were replaced by those shown in Table 2.

Table 2 shows releasing agent No. and the content in the 1st releasing agent component, releasing agent No. and the content in the 2nd releasing agent component and the releasing agent addition amount for each toner.

TABLE 2

| | 1st releasing agent component (Monoester comound) | | 2nd releasing agent component (Monoester comound) | | Releasing agent addition |
|---|---|---|---|---|---|
| Toner No. | Releasing agent No. | Content (% by weight) | Releasing agent No. | Content (% by weight) | amount (% by weight) |
| 1 | 1 | 40 | 7 | 60 | 15 |
| 2 | 2 | 90 | 8 | 10 | 15 |
| 3 | 3 | 80 | 9 | 20 | 15 |
| 4 | 4 | 98 | 10 | 2 | 15 |
| 5 | 3 | 100 | — | 0 | 15 |
| 6 | 3 | 30 | 8 | 70 | 17 |
| 7 | 15 | 80 | 7 | 20 | 17 |
| 8 | 16 | 80 | 7 | 20 | 15 |

[Prepearation of Developers 1-8]

With respect to Toners 1-8, the silicone resin-coated ferrite carrier having a volume based average particle diameter of 60 μm was mixed so as to give a toner content of 6% by weight to prepare "Developers 1-8".

<<Evaluation>>

As an image forming apparatus for evaluation, arranged is one equipped with a contact heating fixing device shown in FIG. 1 {a contact heating fixing device (with a nip width set to 15 mm) in which a heating roller was placed on the upper side of the transfer material so as to be placed on the unfixed toner image side of the transfer material, and a seamless belt was placed on the lower side} in "bizhub PRO C350" manufactured by Konica Minolta Business Technologies, Inc.

In addition, properties concerning a fixing device are also described below.

Heating source: Rated electric power; 600 W

Cylindrical core metal of heating roller: Material; iron, Dimensions; an outer diameter of 30 mm, a radial thickness of 1.8 mm and a length of 36 mm Heat resistant elastic body layer of heating roller: Material; Silicone HTV rubber exhibiting JIS-A hardness 35°, Dimensions; a thickness of 600 μm Releasing layer of heating roller: Material; PFA, Dimensions; a thickness of 30 μm, Surface condition; Mirror-like surface Revolution speed of heating roller: a linear speed of 194 mm/sec Base layer of fixing belt: Material; Thermosetting polyimide, Dimensions; a perimeter of 94 mm, a thickness of 75 μm and a width of 320 mm Releasing layer of fixing belt: Material; PFA, Dimensions; a thickness of 30 μm Pressing member of pressure pad 12*a*: Material: Silicone, Load; 350 N Edge pressing member of pressure pad 12*b*: Material: Polyphenylene sulfide (PPS), Load; 500 N In addition, a contact heating fixing device (with a nip width set to 15 mm) in which a heating belt was placed on the upper side of the transfer material so as to be placed on the unfixed toner image side of the transfer material, and a pressure roller was placed on the lower side of the transfer material, was arranged for image evaluation of comparative example 5. Another contact heating fixing device (with a nip width set to 5 mm) in which a heating roller was placed on the upper side of the transfer material so as to be placed on the unfixed toner image side of the transfer material, and a pressure roller was placed on the lower side the transfer material, was also arranged for image evaluation of comparative example 6.

The above-prepared toner and the developer were arranged to be set in the above-described image forming apparatus equipped with a contact-heating fixing device shown in FIG. 1 in order to conduct image formation at room temperature and normal humidity (20° C. and 55% RH) employing transfer paper sheets "J paper" (a basic weight of 64 g/m$^2$) produced by Konica Minolta Business Technologies, Inc.

In the case of comparative example 5, the above-prepared Toner 1 and Developer 1 were arranged to be set in the above-described image forming apparatus equipped with a contact heating fixing device in which a heating belt was placed on the upper side of the transfer material so as to be placed on the unfixed toner image side of the transfer material, and a pressure roller was placed on the lower side of the transfer material to conduct image formation at the same condition as above.

In the case of comparative example 6, the above-prepared Toner 1 and Developer 1 were arranged to be set in an image forming apparatus equipped with a contact heating fixing device in which a heating roller was placed on the upper side of the transfer material so as to be placed on the unfixed toner image side of the transfer material, and a pressure roller was placed on the lower side of the transfer material to conduct image formation at the same condition as above.

Concerning evaluation, the following items were evaluated.

(Image Defect)

Ten thousand test images having one third each of text images with a pixel ratio of 7%, portrait images and cyan half tone images with a relative image density of 0.6 were printed at the condition where surface temperatures of the seamless belt in the contact heating fixing device were set to 120° C., 140° C. and 160° C., respectively.

A degree of a belt-like or white streak defect generated in the 10000$^{th}$ print image as an image defect was visually evaluated.

Evaluation Criteria

A: No belt-like or white streak defects observed at cyan half tone image portions having a relative image density of 0.6: Excellent B: Belt-like or white streak defects slightly observed at cyan half tone image portions having a relative image density of 0.6: Good C: A couple of lines of white streak defect observed at cyan half tone image portions having a relative image density of 0.6, but no actual defect observed in text images and portrait images: No problem in practical application D: White streak defects clearly observed at cyan half tone image portions having a relative image density of 0.6: Problem in practical application (Fixability)

Solid cyan documents were printed at the condition where surface temperatures of the fixing belt were set to 120° C., 140° C. and 160° C., respectively to obtain print images.

The evaluation was conducted via calculation of fixing strength of the resulting print image by the following method.

A reflective densitometer "RD-918", manufactured by Macbeth Co., Ltd. was employed to measure the image density.

Tape peeling method (1) Measuring absolute reflection density $D_0$ of solid cyan for a square, 5 mm on a side.

(2) Lightly applying "mending tape" (equivalent to No. 810-3-12, produced by Sumitomo 3M Co., Ltd.).

(3) Rubbing the tape 3.5 times in both ways with a pressure of 1 kPa.

(4) Peeling the tape at an angle of 180° with a strength of 200 g.

(5) Measuring absolute reflection density $D_1$ after peeling.

(6) Fixing strength=$100\times D_1/D_0$ (%)

Evaluation Criteria

A: The fixing strength is 95% or more; Excellent.

B: The fixing strength is 90% or more and less than 95%; no problem in practical application.

C: The fixing strength is less than 90%; Problem in practical application.

(Document Offset Property)

Two print images formed in the evaluation of the above-described image defects with which an image surface (printed surface) was superimposed on a non-image surface (on the reverse side) were placed on a glass plate to put a weight equivalent to 7.8 kPa on the superimposed surface, and left standing at the condition of 60° C. and 50% RH for one week. After standing, superimposed two print images were peeled, and a level of the image defect of the peeled print image was visually evaluated, resulting in the following 4 ranks R1-R4. In addition, R3 and R4 are accepted.

R1: A level at which two print images are stuck, and peeling is difficult.

R2: A level at which image movement to the reverse side is observed when peeling two print images.

R3: A tolerable level as an image at which image defects (image movement to the reverse side) are hardly observed, though degraded gloss at image portions is observed.

R4: An excellent level at which no image defect and image movement are observed at image portions as well as at non-image portions.

Evaluation results are shown in Table 3.

TABLE 3

| | | | Evaluation results | | | | | | |
|---|---|---|---|---|---|---|---|---|---|
| | | | 120° C. | | 140° C. | | 160° C. | | |
| | *4 | *5 | Image defect | Fixability | Image defect | Fixability | Image defect | Fixability | *6 |
| Ex. 1 | *1 | 1 | A | B | A | B | B | B | R3 |
| Ex. 2 | *1 | 2 | A | B | A | B | B | A | R4 |
| Ex. 3 | *1 | 3 | A | A | A | A | A | A | R4 |
| Ex. 4 | *1 | 4 | A | A | A | A | A | A | R3 |
| Comp. 1 | *1 | 5 | B | B | D | B | D | B | R1 |
| Comp. 2 | *1 | 6 | B | C | B | C | B | B | R2 |
| Comp. 3 | *1 | 7 | B | C | B | C | A | B | R3 |
| Comp. 4 | *1 | 8 | B | B | B | A | A | A | R2 |
| Comp. 5 | *2 | 1 | A | B | A | B | B | B | R1 |
| Comp. 6 | *3 | 1 | A | C | A | C | A | B | R1 |

*1: Contact heating fixing device shown in FIG. 1 (A contact heating fixing device in which a heating roller is placed on the upper side so as to be on the unfixed toner image side, and a belt-shaped pressure body is placed on the lower side)
*2: Comparative fixing device (A contact heating fixing device in which a heating belt is placed on the upper side so as to be on the unfixed toner image side, and a pressure roller is placed on the lower side)
*3: Comparative fixing device (A contact heating fixing device in which a heating roller is placed on the upper side so as to be on the unfixed toner image side, and a pressure roller is placed on the lower side)
*4 Fixing device
*5 Toner No.
*6 Document offset property
Ex.: Example
Comp.: Comparative example As is clear from Table 3, it is to be understood that in the case of image formation of Examples 1-4 with toners of the present invention and fixing devices of the present invention, there is no problem produced in image defects, fixing strength and document offsetting.

On the other hand, it is also understood that in the case of image formation of Comparative examples 1-6 with comparative toners and comparative fixing devices, there are problems produced in any of the evaluation items, and the objective of the present invention has not been accomplished.

Effect of the Invention

The image forming method of the present invention produces an excellent effect such that sufficient fixing strength can be obtained even at a low temperature of for example 120° C., excellent print images with no belt-like or streak image defect can be obtained, and no document offsetting is generated even though the print images are stored.

What is claimed is:

1. An image forming method comprising the step of:

fixing a toner image formed with a toner comprising a releasing agent on a transfer material employing a contact-heating fixing device comprising a heating roller and a belt-shaped pressure body, wherein the heating roller is placed on an unfixed toner image side of the transfer material; the belt-shaped pressure body is placed on a side opposite to the unfixed toner image side of the transfer material; a nip portion is formed with the heating roller and the belt-shaped pressure body; the belt-shaped pressure body having only two pressure pads to create the nip portion, where one of the two pressure pads is provided on an entrance side of the nip portion, and another one of the two pressure pads is provided on an exit side of the nip portion, a relationship between pressure X on the entrance side of the nip portion and pressure Y on the exit side of the nip portion satisfies X<Y; the releasing agent comprises a $1^{st}$ releasing agent component containing a monoester compound represented by the following Formula (1) and a $2^{nd}$ releasing agent component containing a hydrocarbon compound having a branched chain structure; and the $1^{st}$ releasing agent component has a content of 40-98% by weight, based on the total weight of the $1^{st}$ releasing agent component and the $2^{nd}$ releasing agent component:

$$R^1—COO—R^2 \qquad \text{Formula (1)}$$

wherein $R^1$ and $R^2$ each represent a hydrocarbon group with a main chain having 13-30 carbon atoms, that may have a substituent, or may not have a substituent, and $R^1$ and $R^2$ each may be identical or different.

2. The image forming method of claim 1, wherein the $1^{st}$ releasing agent component has a content of 70-95% by weight, based on the total weight of the $1^{st}$ releasing agent component and the $2^{nd}$ releasing agent component.

3. The image forming method of claim 1, wherein tertiary carbon atoms and quaternary carbon atoms in the total carbon atoms constituting the hydrocarbon compound having a branched chain structure have a content of 0.1-20% by weight.

4. The image forming method of claim 1, wherein tertiary carbon atoms and quaternary carbon atoms in the total carbon atoms constituting the hydrocarbon compound having a branched chain structure have a content of 0.3-1.0% by weight.

5. The image forming method of claim 1, wherein the hydrocarbon compound having a branched chain structure is microcrystalline wax.

6. The image forming method of claim 5, wherein the microcrystalline wax has 30-60 carbon atoms, a weight-average molecular weight of 500-800 and a melting point of 60-90° C.

7. The image forming method of claim 1, wherein the nip portion formed with the heating roller and the belt-shaped pressure body has a width of 5-40 mm.

8. The image forming method of claim 1, wherein the nip portion formed with the heating roller and the belt-shaped pressure body has a width of 10-30 mm.

9. The image forming method of claim 1, wherein the belt-shaped pressure body is a seamless belt.

10. The image forming method of claim 9, wherein the seamless belt is one having a layered structure formed from silicone rubber elastic layers and a PFA (perfluoroalkoxy) outer surface layer provided on a polyimide substrate.

11. The image forming method of claim 9, wherein the seamless belt is one having a layered structure obtained by coating a releasing layer, in which a conductive material is added into a fluorine resin on a polyester substrate, a polyperfluoroalkyl vinyl ether substrate, a polyimide substrate or a polyetherimide substrate.

12. The image forming method of claim 1, wherein the pressure X is 300-500 N and the pressure Y is 400-600 N, provided that X<Y.

* * * * *